United States Patent [19]

Hain

[11] Patent Number: 4,936,564

[45] Date of Patent: Jun. 26, 1990

[54] SHEET HANDLING APPARATUS

[75] Inventor: David A. Hain, Dundee, Scotland

[73] Assignee: NCR Corporation, Dayton, Ohio

[21] Appl. No.: 342,513

[22] Filed: Apr. 24, 1989

[30] Foreign Application Priority Data

Nov. 3, 1988 [GB] United Kingdom ..... 8825756

[51] Int. Cl.[5] ..... B65H 5/02

[52] U.S. Cl. ..... 271/3; 271/7; 271/273; 271/274; 271/69; 271/298; 271/198

[58] Field of Search ..... 271/3, 4, 7, 9, 10, 271/272, 273, 274, 298, 69, 198, 315, 225, 184, 187; 209/534; 221/9, 10, 13; 902/17, 15

[56] References Cited

U.S. PATENT DOCUMENTS

| | | | |
|---|---|---|---|
| 4,578,009 | 3/1986 | Granzow et al. | 414/43 |
| 4,649,832 | 3/1987 | Hain et al. | 109/24.1 |
| 4,697,944 | 10/1987 | Peebles et al. | 400/635 |
| 4,709,820 | 12/1987 | Jenkins et al. | 209/534 |
| 4,813,658 | 3/1989 | Hosking et al. | 271/10 |
| 4,822,018 | 4/1989 | Hain | 271/3 |

FOREIGN PATENT DOCUMENTS 2106687 7/1982 United Kingdom .

*Primary Examiner*—Michael S. Huppert
*Assistant Examiner*—David H. Bollinger
*Attorney, Agent, or Firm*—Wilbert Hawk, Jr.; Albert L. Sessler, Jr.

[57] ABSTRACT

A cash dispensing unit includes first (68) and second (70) cooperating endless groups of belts for feeding a stack (72) of currency notes to an exit location (50). First ends of the first (68) and second (70) groups of belts respectively pass round first (26) and second (30) group of pulleys of equal diameter mounted in a central position of a support framework (11), and second ends of the two groups of belts (68, 70) respectively pass round two smaller groups of pulleys (66, 52) disposed adjacent the exit location (50). The first group of belts (68) pass partly around the periphery of the second group of pulleys (30), and are resiliently stretchable so that the stack (72) can pass between this group of belts (68) and this group of pulleys (30). The cash dispensing unit can be a rear loading unit in which the smaller groups of pulleys (66, 52) are located adjacent one end of the framework (11), or can be a front loading unit in which these groups of pulleys (66, 52) are repositioned adjacent the opposite end of the framework (11).

7 Claims, 6 Drawing Sheets

SHEET HANDLING APPARATUS

BACKGROUND OF THE INVENTION

The invention has application, for example, to a currency note stacking and presenting mechanism included in a cash dispenser unit of an automated teller machine (ATM). As is well known, in operation of an ATM a user inserts a customer identifying card into the machine and then enters certain data (such as codes, quantity of currency required, type of transaction, etc.) upon one or more keyboards included in a user console of the machine. The machine will then process the transaction, update the user's account to reflect the current transaction, dispense cash, when requested, from one or more currency cassettes mounted in the machine, and return the card to the user as part of a routine operation.

A cash dispenser unit of an ATM typically includes at least one note picking mechanism for extracting notes one by one from an associated currency cassette, and a stacking and presenting mechanism for accumulating the extracted notes into a stack and then feeding the stack of notes to a delivery port or exit slot in the ATM from where the stack may be removed by a user of the ATM.

A cash dispenser unit of an ATM may be of the rear loading type in which currency cassettes are removed from, and replaced in, the dispenser unit from the rear of the ATM, that is the side of the ATM opposite the user console, or it may be of the front loading type in which currency cassettes are removed from, and replaced in, the dispenser unit from the front of the ATM. Normally, a through-the-wall ATM, in which the user console is mounted in a wall of a bank or other building, includes a cash dispenser unit of the rear loading type, while an in-lobby ATM located inside a bank or other building may include a cash dispenser unit of either the rear loading or front loading type.

From U.K. Patent Application No. 2106687A there is known a cash dispenser mechanism which can be modified so as to have either a front loading or a rear loading configuration. This known mechanism comprises upper and lower units, the upper unit housing stacking means and transport means for feeding a stack of currency notes to an exit port and for feeding rejected notes to a rejected note container positioned at the rear of the mechanism, and the lower unit housing currency note dispensing compartments and transport means for feeding notes to the upper unit. The whole of the lower unit is rotatable through 180° with respect to the upper unit during installation, whereby the installed cash dispenser mechanism can be either front loading or rear loading. This arrangement has the potential advantage of increasing the manufacturer's productivity, since it is not necessary to manufacture two different types of cash dispensing mechanisms for front loading and rear loading operation. However, this known cash dispensing mechanism has the disadvantage that complexities are introduced due to the need to rotate the whole of the lower unit relative to the upper unit. For example, it is necessary to provide adjustable gate means for diverting notes from the lower unit to the upper unit, such gates being liable to give rise to jamming of the notes. A further disadvantage of this known mechanism is that when the mechanism is in a front loading configuration the rejected note container remains at the rear of the mechanism, which gives rise to difficulties in obtaining access to this container for removing notes therefrom.

SUMMARY OF THE INVENTION

The present invention relates to a sheet handling apparatus and more particularly relates to a sheet handling apparatus suitable for use as a cash dispenser unit which can be readily adapted for use as either a front loading unit or a rear loading unit.

According to the invention there is provided a sheet handling apparatus including stacking means for accumulating sheets into a stack, and feeding means for feeding said stack to an exit location, said feeding means comprising a supporting framework; first and second pulley means having fixed axes and being mounted in a central portion of said supporting framework; third and fourth pulley means mounted in said supporting framework and disposed adjacent said exit location; and first and second endless belt means, first ends of said first and second belt means respectively passing around first and second pulley means, second ends of said first and second belt means respectively passing around said third and fourth pulley means, said first belt means being resiliently stretchable, part of said first belt means being in cooperative relationship with respect to part of said second belt means for the purpose of feeding said stack to said exit location, said first and second pulley means having substantially the same diameter and serving to drive said first and second belt means, said first belt means passing partly around the periphery of said second pulley means.

It is accordingly an object of the present invention to provide a sheet handling apparatus of simple construction which is suitable for use as a cash dispenser unit.

A further object is to provide a sheet handling apparatus suitable for use as a cash dispenser unit which can be readily adapted for use as either a front loading unit or a rear loading unit.

With these and other objects, which will become apparent from the following description, in view, the invention includes certain novel features of construction and combinations of parts, a preferred form or embodiment of which is hereinafter described with reference to the drawings which accompany and form a part of this specification.

DETAILED DESCRIPTION

Figure 1:
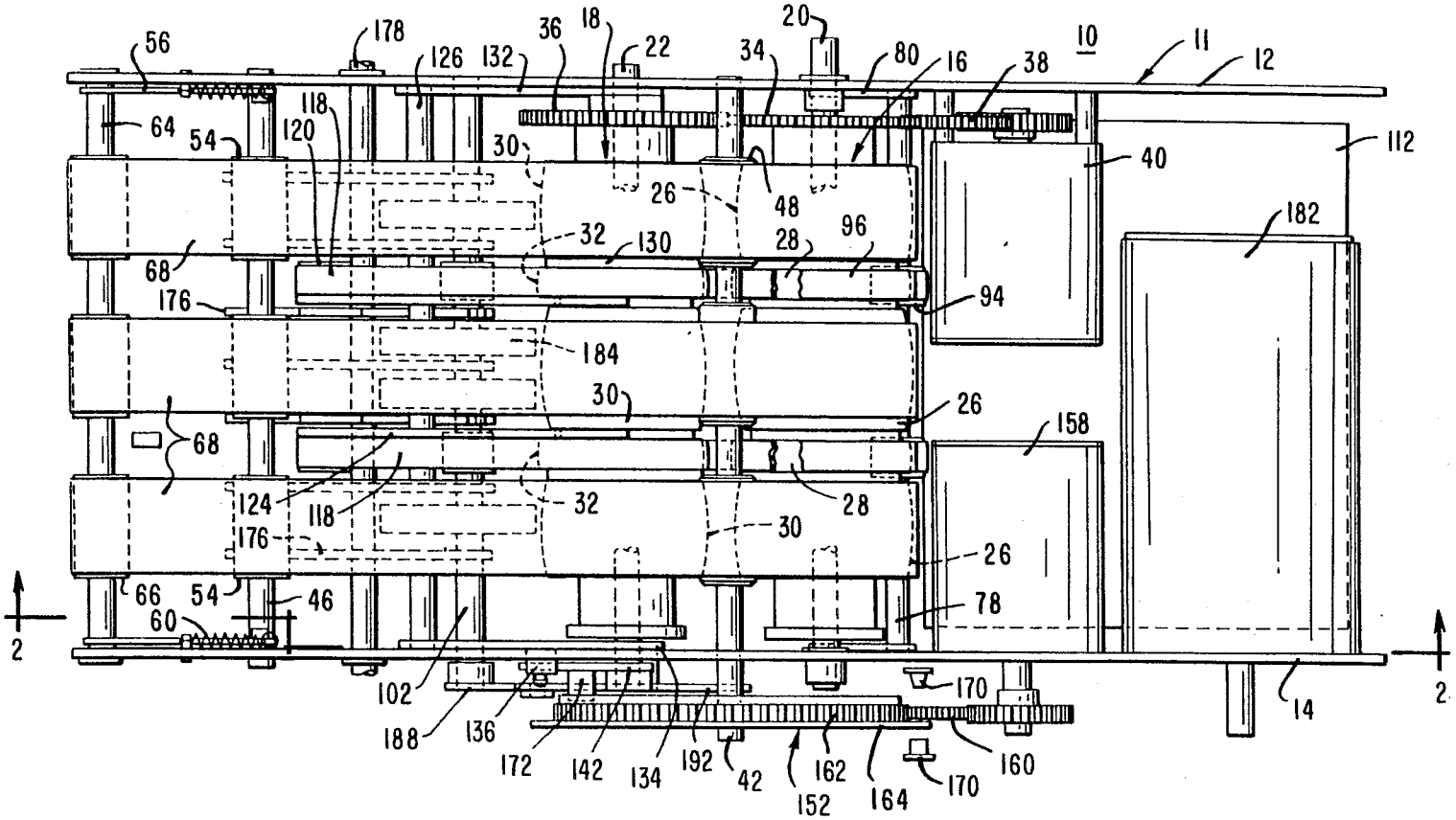
FIG. 1 is a plan view of a currency note stacking and presenting mechanism of an ATM showing the mechanism in a rear loading configuration.
Figure 2:
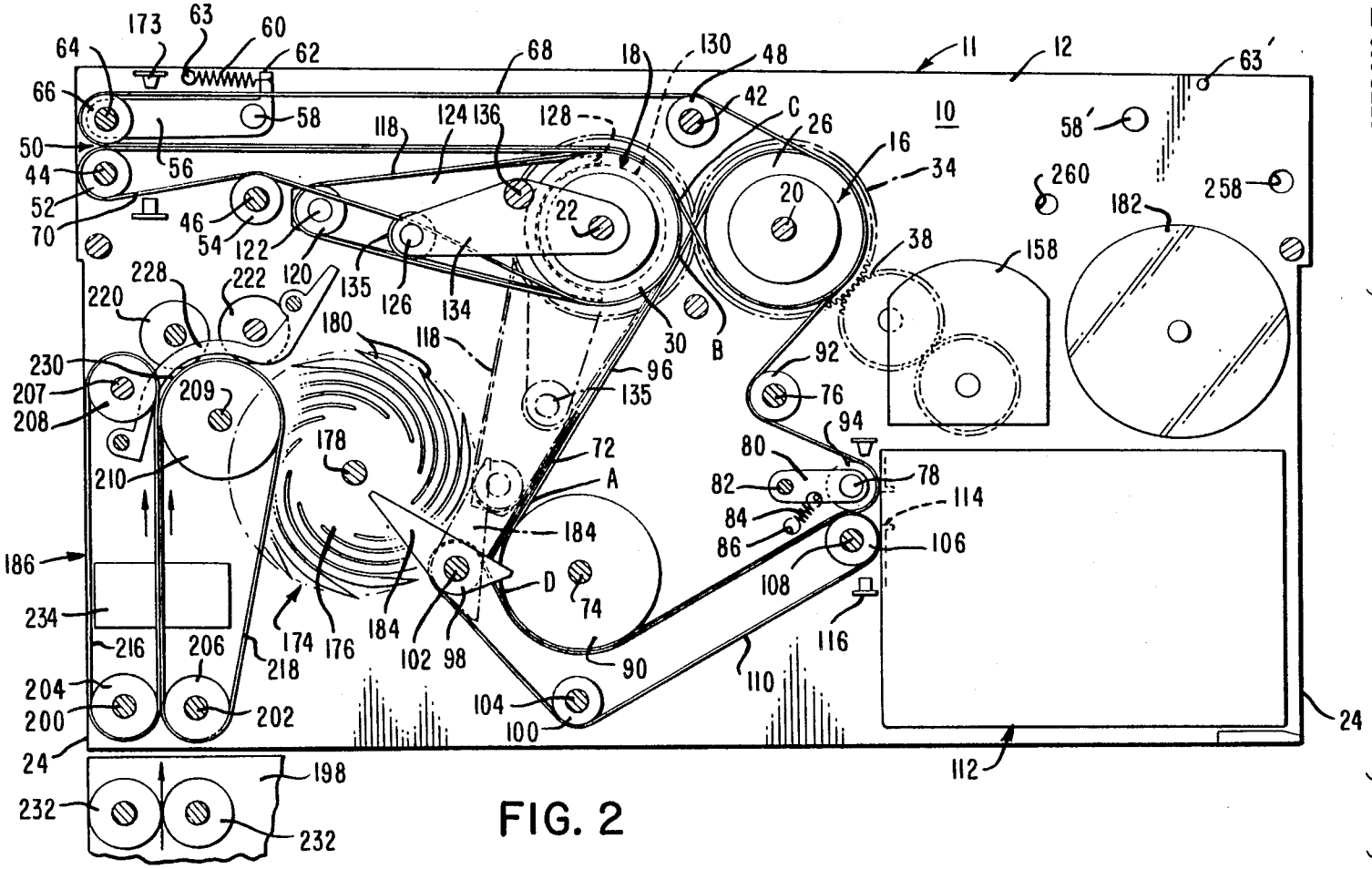
FIG. 2 is a sectional, side elevational view of the mechanism of FIG. 1, the section being taken along the line 2—2 of FIG. 1.

Referring to FIGS. 1 and 2, the stacking and presenting mechanism 10 shown therein includes a supporting framework 11 having side walls 12 and 14. Two composite pulleys 16 and 18 are respectively rotatably mounted on two parallel shafts 20 and 22 which extend between the side walls 12 and 14, the axes of the shafts 20 and 22 lying in the same horizontal plane in a central portion of the framework 11 and being symmetrically positioned with respect to the ends 24 of each of the side walls 12 and 14. The composite pulley 16 includes three wide pulley portions 26 spaced apart along the shaft 20, and two further, narrower pulley portions 28 which are interposed with respect to the pulley portions 26 as seen in FIG. 1. Similarly, the composite pulley 18 includes three pulley portions 30 which are similar to, and are correspondingly located with respect to, the pulley portions 26, and two further pulley portions 32 which are similar to, and are correspondingly located with respect to, the pulley portions 28. Hereinafter, the pulley portions 26, 28, 30, or 32 will simply be referred to as pulleys 26, 28, 30 or 32. The pulleys 26 and 30 have a diameter of 6.4 centimeters at their centers, and the axes of the shafts 20 and 22 are spaced 7.5 centimeters apart. Two meshing gear wheels 34 and 36 are respectively secured to the composite pulleys 16 and 18, the gear wheel 34 being coupled via a gear system 38 to an electric motor 40 which serves to drive the composite pulleys 16 and 18.

Three further shafts 42, 44, and 46 extend between the side walls 12 and 14 in an upper portion of the framework 11. The shaft 42 is disposed above the shafts 20 and 22 and is symmetrically positioned with respect thereto. Rotatably mounted on the shaft 42 are three pulleys 48 which are correspondingly located with respect to the pulleys 26 and 30. The shaft 44 is located adjacent an exit location 50 (FIG. 2) of the stacking and presenting mechanism 10, and the shaft 46 is located at an intermediate position with respect to the shafts 44 and 22. Three pulleys 52 are rotatably mounted on the shaft 44, and three pulleys 54 are rotatably mounted on the shaft 46, the pulleys 52 and the pulleys 54 being correspondingly located with respect to the pulleys 26, 30 and 48.

Two arms 56 are respectively rotatably mounted on two studs 58 respectively secured to the inner faces of the side walls 12 and 14. Each of the arms 56 is urged to rotate in a counterclockwise direction with reference to FIG. 2 by means of an associated spring 60, the ends of which are respectively attached to a lug 62 provided on one end of the relevant arm 56 and to a stud 63 secured to the inner face of the relevant side wall 12 and 14. A shaft 64 extends between, and is carried by, the ends of the arms 56 remote from the lugs 62. Rotatably mounted on the shaft 64 are three pulleys 66 which are correspondingly located with respect to the pulleys 26, 30, 48, 52 and 54. Three resiliently stretchable endless belts 68 pass around the pulleys 26, 48 and 66, each belt 68 being cooperatively associated with a set of correspondingly located pulleys 26, 48 and 66 as seen in FIG. 1, and also passing partly around the periphery of the correspondingly located pulley 30 as seen in FIG. 2. Three further endless belts 70 pass around the pulleys 30 and 52 and over the pulleys 54 as seen in FIG. 2, each belt 70 being cooperatively associated with a set of correspondingly located pulleys 30, 52 and 54.

It will be appreciated that those parts of the belts 68 extending between the pulleys 66 and 30 are respectively in cooperative engagement with those parts of the belts 70 extending between the pulleys 52 and 30. The said parts of the belt 68 are held in resilient engagement with the cooperating parts of the belts 70 by virtue of the pulleys 66 being urged into cooperative relationship with the pulleys 52 under the action of the springs 60, and by virtue of the belts 68 passing partly around the peripheries of the pulleys 30 with the belts 68 being in a slightly tensioned condition. As will be described in more detail later, by virtue of the resilient nature of the engagement of the belts 68 with the belts 70, a stack of currency notes 72 (FIG. 2) comprising a variable number of notes, can be fed to the exit location 50 of the mechanism 10 by virtue of being gripped between the cooperating parts of the belts 68 and 70.

Located beneath the composite pulleys 16 and 18 are two shafts 74 and 76 which extend between the side walls 12 and 14, and a shaft 78 which extends between, and is carried by, the ends of two arms 80. The arms 80 are respectively rotatably mounted on two studs 82 respectively secured to the inner faces of the side walls 12 and 14. Each of the arms 80 is urged to rotate in a clockwise direction with reference to FIG. 2 by means of an associated spring 84 (not shown in FIG. 1), the ends of which are respectively attached to a portion of the relevant arm 80 intermediate the shaft 78 and the relevant stud 82, and to a stud 86 secured to the inner face of the relevant side wall 12 or 14. Three pairs of pulleys 90, 92, and 94 are respectively rotatably mounted on the shafts 74, 76 and 78, the pulleys 90, 92 or 94 of each pair being correspondingly located with respect to the pulleys 28 of the composite pulley 16. The pulleys 90 have a diameter of 6.4 centimeters, this diameter being considerably greater than that of the pulleys 92 and 94. Two resiliently stretchable endless belts 96 pass around the pulleys 28, 90 and 94 and partly around the pulleys 92, each belt 96 being cooperatively associated with a set of correspondingly located pulleys 28, 90, 92 and 94. Two further pairs of pulleys 98 and 100 are respectively rotatably mounted on two shafts 102 and 104 extending between the side walls 12 and 14, and another pair of pulleys 106 is secured on a drive shaft 108 extending between, and rotatably mounted with respect to, the side walls 12 and 14. The drive shaft 108 is driven by the electric motor 40 via a gear system (not shown). Two resiliently stretchable endless belts 110 pass around the pulleys 98, 100 and 106, and partially around the pulleys 90 as seen in FIG. 2, each belt 110 being cooperatively associated with a set of correspondingly located pulleys 90, 98, 100 and 106.

It will be appreciated that those parts of the belts 110 extending between the pulleys 106 and 90 are respectively in cooperative engagement with those parts of the belts 96 extending between the pulleys 94 and 90. The said parts of the belts 110 are held in resilient engagement with the cooperating parts of the belts 96 by virtue of the pulleys 94 being urged into cooperative relationship with the pulleys 106 under the action of the springs 84, and by virtue of the belts 110 passing partly around the peripheries of the pulleys 90 with the belts 110 being in a slightly tensioned condition.

As will be described in more detail later, by virtue of the resilient nature of the engagement of the belts 110 with the belts 96, a stack of rejected currency notes, comprising a variable number of notes, can be fed by the belts 96 and 110, while gripped between the cooperating parts thereof, to a rejected note container 112 (hereinafter referred to as the purge bin 112), the rejected notes being deposited in the purge bin 112 via an opening 114 in one side thereof. The passage of a stack of rejected currency notes into the purge bin 112 is sensed by optical sensing means 116 (FIG. 2).

Two further endless belts 118 respectively pass around the pulleys 32 forming part of the composite pulley 18, and also around two pulleys 120 which are rotatably mounted on two studs 122 respectively provided on corresponding ends of two arms 124. The arms 124 are supported by a shaft 126 which passes through the arms 124, and the ends of the arms 124 remote from the studs 122 are formed as curved portions 128 which slidably engage with respective portions 130 of the composite pulley 18; by virtue of this arrangement, the arms 124 are pivotable about the axis of the shaft 22 under the control of the shaft 126. The ends of the shaft 126 are respectively secured to corresponding ends of two further arms 132 and 134 which are respectively disposed adjacent the inner surfaces of the side walls 12 and 14, the other ends of the arms 132 and 134 being secured on the shaft 22 which is rotatably mounted with respect to the side walls 12 and 14. Two pulleys 135 mounted on the shaft 126 are respectively disposed inside the endless belts 118. The pulleys 135 are in cooperative engagement with the lower parts of the belts 118 extending between the pulleys 120 and 32.

Figure 3:
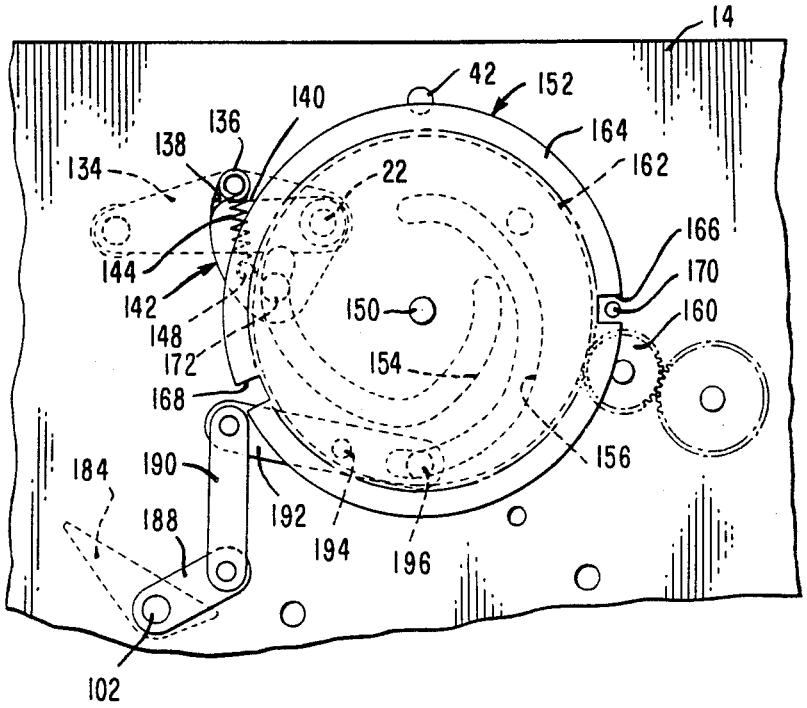
FIG. 3 is a side elevational view of part of the mechanism shown in FIG. 1, this view being from the same side as the view shown in FIG. 2.

Referring now also to FIG. 3, a stud 136 secured to the arm 134 extends through an arcuate slot 138 formed in the side wall 14, the stud 136 being engageable with an edge portion 140 of an arm 142 which is rotatably mounted on an end portion of the shaft 22 projecting beyond the side wall 14. The stud 136 is normally held in resilient engagement with the edge portion 140 by means of a spring 144 the ends of which are respectively attached to the stud 136 and to a stud 148 secured to the arm 142. A shaft 150 extending between the side walls 12 and 14 is centrally located with respect to the framework 11, and a cam 152 is rotatably mounted on a portion of the shaft 150 extending beyond the side wall 14. Two cam tracks 154 and 156, in the form of arcuate recesses, are formed in the inner surface of the cam 152 facing the side wall 14. The cam 152 is driven by an electric motor 158 via a gear system 160, the gear system 160 engaging with a gear wheel 162 forming an integral part of the cam 152. The cam 152 is provided with a peripheral flange 164 in which are formed two notches 166 and 168.

During rotation of the cam 152, optical sensor means 170 are arranged to sense the notches 166 and 168 for a purpose which will be explained later. A stud 172 secured to the outer face of the arm 142 engages in the cam track 154 formed in the cam 152. Normally, the assembly of the belts 118 and the arms 124, 132, 134 and 142 is in the position shown in solid outline in FIG. 2, and the cam 152 is in the position shown in FIG. 3. In response to rotational movement of the cam 152 in a clockwise direction from the position shown in FIG. 3, pivotal movement of the arm 142 in a counterclockwise direction about the axis of the shaft 22 is brought about by virtue of the engagement of the stud 172 in the cam track 154. This pivotal movement of the arm 142 in turns brings about pivotal movement of the arms 132, 134 and 124 under the action of the spring 144. Thus, the above-mentioned rotational movement of the cam 152 brings about pivotal movement in a counterclockwise direction (with reference to FIGS. 2 and 3) of the assembly of the arms 124, 132, 134 and 142, the pulleys 120 and 135 and the belts 118. This pivotal movement continues until the belts 118 come into cooperative relationship with the belts 96 (with the stack of notes 72 gripped between the belts 118 and 96) as shown in chain outline in FIG. 2, at which time the rotational movement of the cam 152 is stopped. The cooperating parts of the belts 118 and 96 extend between a location A adjacent the peripheries of the pulleys 90 and a location B at which the belts 118 and 96 are in cooperative relationship with respect to the peripheries of the pulleys 32.

It should be understood that the pulleys 135 serve to support the parts of the belts 118 extending between locations A and B. The stack of currency notes 72 resting against the belts 96 is gripped resiliently between the belts 118 and 96 under the action of the spring 144, the spring 144 being extended to some extent depending on the thickness of the stack. With the stack of notes 72 thus gripped between the belts 118 and 96, the stack can be fed by the belts 118 and 96 to the nip C of the belts 68 and 70 from where the stack is fed by the belts 68 and 70 to the exit location 50, the approach of the stack to the exit location 50 being sensed by optical sensing means 173 positioned adjacent the exit location 50; it should be understood that the resiliently stretchable nature of the belts 96 enables the relevant parts of the belts 96 to be moved away from the peripheries of the pulleys 32 as the stack of notes 72 passes through location B. Alternatively, the stack of notes 72 gripped between the belts 118 and 96 can be fed by the belts 118 and 96 to the nip D of the belts 96 and 110 from where the stack is fed by the belts 96 and 110 into the purge bin 112.

All of the belts 68, 70, 96, 110 and 118 are of an elastomeric material such as polyurethane or silicone rubber. However, it should be understood that for successful operation of the stacking and presenting mechanism 10 it is not essential that the belts 70 and 118 are resiliently stretchable.

As shown in FIGS. 1 and 2, the stacking and presenting mechanism 10 includes a conventional stacking wheel 174 which is arranged to rotate continuously in operation in a clockwise direction with reference to FIG. 2. The stacking wheel 174 comprises a plurality of stacking plates 176 spaced apart in parallel relationship along a stacking wheel shaft 178, each stacking plate 176 incorporating a series of curved tines 180. The shaft 178 extends between, and is rotatably mounted with respect to, the side walls 12 and 14, and the shaft 178 is driven via transmission means (not shown) by an electric motor 182. The stacking wheel 174 cooperates with a series of stripper arms 184 which are spaced apart along the shaft 102 and are secured thereto, the shaft 102 being rotatably mounted with respect to the side walls 12 and 14. Each stripper arm 184 is positioned between an adjacent pair of stacking plates 176 as seen in FIG. 1.

During a stacking operation, the stripper arms 184 are positioned as shown in solid outline in FIG. 2 with each stripper arm 184 extending into the space between adjacent stacking plates 176. In such operation, currency notes are fed one by one to the stacking wheel 174 by a transport mechanism 186 (which for the sake of clarity is not shown in FIG. 1). Each note enters between adjacent tines 180 of the stacking plates 176 and is carried partly around the axis of the stacking wheel 174, the note being stripped from the wheel 174 by the stripper arms 184 and being stacked against the belts 96 as shown in FIG. 2 with a long edge of the note resting on the stripper arms 184.

Referring again also to FIG. 3, one end of an arm 188 is secured to a portion of the shaft 102 projecting beyond the side wall 14. The other end of the arm 188 is connected via a link member 190 to one end of an arm 192 which is pivotably mounted on a stud 194 secured to the outer surface of the side wall 14. A stud 196 secured to that end of the arm 192 remote from the link member 190 engages in the cam track 156 formed in the cam 152. As previously mentioned, the cam 152 is normally in the position shown in FIG. 3. Also, normally the assembly of the arm 192, link member 190, arm 188 and stripper arms 184 is as shown in FIG. 3, with the stripper arms 184 being positioned as shown in solid outline in FIG. 2.

In response to rotational movement of the cam 152 in a clockwise direction from the position shown in FIG. 3, pivotal movement of the arm 192 in a counterclockwise direction about the stud 194 is brought about by virtue of the engagement of the stud 196 in the cam track 156. This pivotal movement of the arm 192 in turn brings about pivotal movement of the stripper arms 184 in a clockwise direction (with reference to FIGS. 2 and 3) about the axis of the shaft 102, such movement of the stripper arms 184 being brought about via the link member 190, the arm 188 and the shaft 102. The just-described pivotal movement of the stripper arms 184 continues until the stripper arms 184 reach the position shown in chain outline in FIG. 2, at which time the rotational movement of the cam 152 is stopped; with the stripper arms 184 in this position, the stack of currency notes 72 gripped between the belts 118 and the belts 96 can be fed by the belts 118 and 96 either towards the exit location 50 or towards the purge bin 112, depending on the sense of operation of the motor 40.

Referring to FIG. 2, the transport mechanism 186 serves to feed currency notes from a pick module 198 (see also FIG. 4) to the stacking wheel 174. The mechanism 186 includes two drive shafts 200 and 202 which extend between, and are rotatably mounted with respect to, the side walls 12 and 14, the shafts 200 and 202 being driven via transmission means (not shown) by the electric motor 182. Four pulleys 204 are secured on, and spaced apart along, the shaft 200, and four pulleys 206, correspondingly located with respect to the pulleys 204, are secured on the shaft 202. Two further sets of pulleys 208 and 210, each set comprising four pulleys, are respectively rotatably mounted on two shafts 207 and 209, extending between the side walls 12 and 14, the pulleys 208 and the pulleys 210 being correspondingly located with respect to the pulleys 204 and 206. Four endless belts 216 respectively pass around the pulleys 204 and 208, and four endless belts 218 respectively pass around the pulleys 206 and 210. The belts 216 are positioned in cooperative relationship with the belts 218 for the purpose of feeding currency notes therebetween. A part of each belt 218 and a part of the associated pulley 210 are positioned between an adjacent pair of stacking plates 176 of the stacking wheel 174. Two sets of friction rolls 220 and 222 are positioned in cooperative relationship with respect to the belts 218, the rolls 220 and the rolls 222 respectively engaging the parts of the belts 218 in contact with the pulleys 210. A set of guide members 228, which are interposed with respect to the pulleys 208, belts 216, and rolls 220 and 222, serve to define a passageway 230 for currency notes between the members 228 and the parts of the belts 218 in contact with the pulleys 210.

In operation, the belts 216 and 218 are driven by the pulleys 204 and 206 in the directions indicated by the arrows in FIG. 2, and each currency note fed to the transport mechanism 186 by feed rolls 232 included in the pick module 198 is fed by the belts 216 and 218 to the passageway 230, whereafter the note is fed through the passageway 230 by the friction rolls 220, 222 and belts 218 and eventually deposited between adjacent tines 180 of the stacking plates 176 as previously described. A multiple note detect means 234, schematically indicated as a box in FIG. 2, is positioned part way along the cooperating parts of the belts 216 and 218 for the purpose of detecting the passage of superposed notes between the belts 216 and 218.

Figure 4:
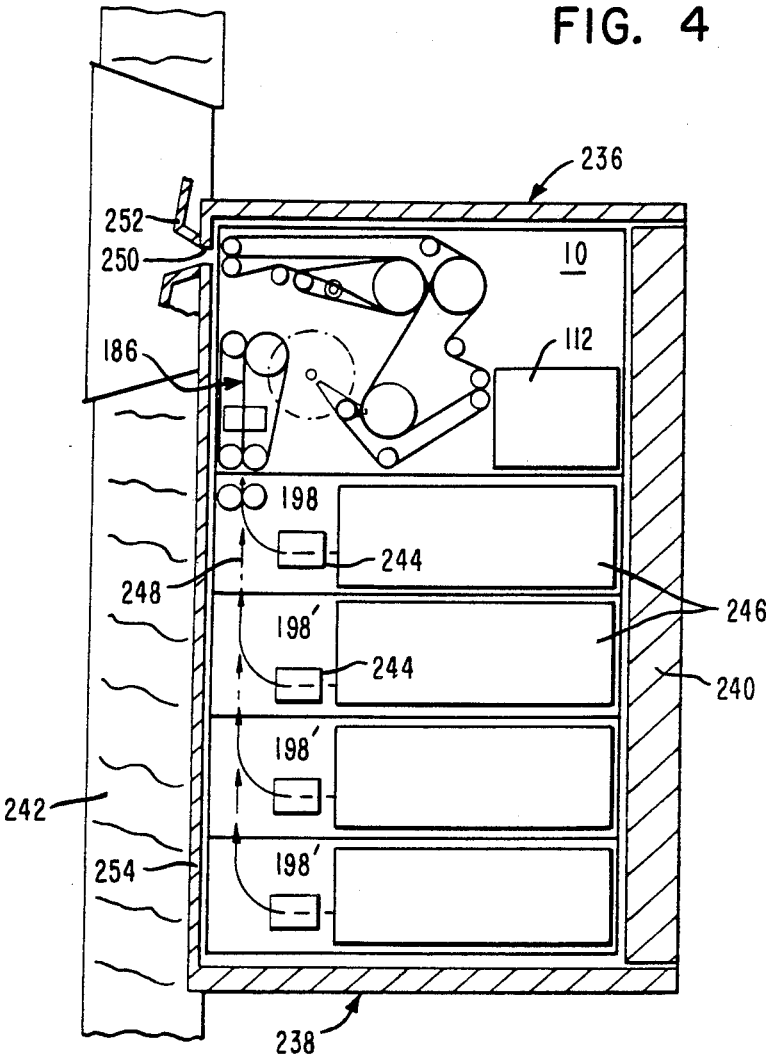
FIG. 4 is a schematic side elevational view of an ATM having a cash dispenser unit incorporating the stacking and presenting mechanism of FIGS. 1 to 3.

Referring now to FIG. 4, the note stacking and presenting mechanism 10 forms part of a cash dispenser unit 236 of a through-the-wall ATM. The mechanism 10, the pick module 198 and additional pick modules 198' are housed in a safe 238, having a rear door 240, the safe 238 being mounted in juxtaposition with an outer wall 242 of a bank or other building. Each of the pick modules 198, 198' includes a conventional pick mechanism 244 arranged to pick currency notes one by one from an associated currency cassette 246, and arranged to feed each note picked from the associated cassette 246 along a common feed path 248 to the transport mechanism 186 of the mechanism 10. Notes picked from one or more of the cassettes 246 are stacked by the mechanism 10 as previously described, and are then presented to a user of the ATM via a delivery port 250 formed in a user console 252 of the ATM.

Alternatively, if a stack of notes is rejected for any reason, for example as a result of the double detect mechanism 234 detecting the passage of superposed notes, the stack is diverted to the purge bin 112. It should be noted that the purge bin 112 is positioned above the currency cassettes 246. With the safe door 240 opened, the cassettes 246 and the bin 112 can each be removed from the safe 238 (e.g. as part of a cash replenishment or bin emptying operation) by withdrawing the cassette 246 or bin 112 away from the front wall 254 of the safe 238. The cash dispenser unit 236 includes electronic control means 256 (FIG. 5) which controls the operation of the motors 40, 158 and 182 and the pick mechanisms 244, and to which are applied outputs of the sensor means 116, 170 and 173 and the multiple note detect mechanism 234. It should be understood that the drive motor 182 operates the stacking wheel 174, the drive shafts 200 and 202, and the pick mechanisms 244.

Figure 5:
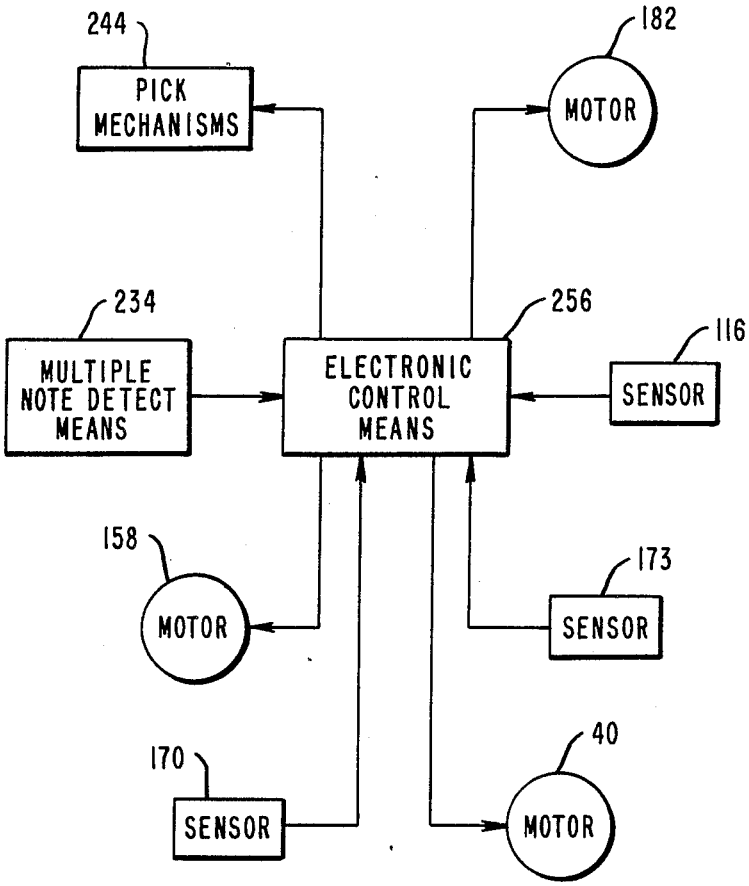
FIG. 5 is a schematic block diagram illustrating the electrical interconnections of parts of the cash dispenser unit of FIG. 4.

The operation of the cash dispenser unit 236, and particularly the operation of the stacking and presenting mechanism 10, will now be described with additional reference to FIG. 5. Immediately prior to a cash dispensing operation being initiated, the motors 40, 158 and 182 are in a deactivated condition, the belts 118 and the stripper arms 184 are in the positions shown in solid outline in FIG. 2, and the cam 152 is in the position shown in FIG. 3 with the notch 166 aligned with the sensor means 170.

A cash dispensing operation is initiated by a user inserting a customer identifying card into a card entry slot (not shown) in the user console 252 (FIG. 4) and entering appropriate data upon keyboard means (not shown) also included in the user console 252. As a result of this operation being initiated, the drive motor 182 is activated by the control means 256 so as to operate the transport mechanism 186 and cause the stacking wheel 174 to commence rotation. Currency notes are then picked one by one from a selected one or selected ones of the cassettes 246 in response to the application of signals to the relevant pick mechanism or mechanisms 244 by the electronic control means 256. The picked notes are fed by the transport mechanism 186 to the stacking wheel 174 which stacks the notes against the stationary belts 96 in the manner previously described so as to form the stack 72.

When the correct number of notes have been stacked against the belts 96, the electronic control means 256 sends a signal to the motor 158 so as to activate the motor 158 in such a sense as to rotate the cam 152 in a clockwise direction with reference to FIG. 3. This rotation of the cam 152 brings about a pivotal movement of the belts 118 in a counterclockwise direction with reference to FIG. 2 so as to cause the stack of notes 72 to be clamped between the belts 118 and the belts 96; at the same time, the stripper arms 184 are moved to the position shown in chain outline in FIG. 2 in which the arms 184 are no longer in engagement with, or in a path of movement of, the stack of notes 72.

Shortly after the stack of notes 72 is clamped between the belts 118 and 96, the electronic control means 256 deactivates the motor 158 so as to stop the cam 152 in response to the sensor means 170 sensing the notch 168 in the flange 164 of the cam 152. Thereafter, the electronic control means 256 sends a signal to the motor 40 so as to activate the motor 40 in such a sense as to cause the belts 118 and 96 to feed the stack of notes 72 to the nip C of the belts 68 and 70 from where the stack is fed by the belts 68 and 70 to the delivery port 250 of the ATM via the exit location 50 of the mechanism 10. As the stack of notes approaches the delivery port 250, the sensor means 173 senses the leading edge of the stack. A predetermined time after the leading edge of the stack of notes is sensed by the sensor means 173, the electronic control means 256 deactivates the motor 40 so as to stop the stack in a delivery position in which part of the stack projects through the delivery port 250 and part of the stack is held between the belts 68 and 70.

After being fed to the delivery position, the stack of notes can be readily removed from the user console 252 by the user of the ATM. Also in response to the sensing of the leading edge of the stack by the sensing means 173, the electronic control means 256 deactivates the motor 182, and activates the motor 158 in the reverse sense so as to bring about a rotation of the cam 152 in a counterclockwise direction with reference to FIG. 3 and thereby cause the stripper arms 184 and the assembly of the belts 118 and the arms 124, 132, 134 and 142 to be returned to the position shown in solid outline in FIG. 2 by virtue of the engagement of the stud 172 in the cam track 154. Activation of the motor 158 in the reverse sense is terminated when the sensor means 170 senses the notch 166. It should be understood that, by virtue of the stretchable nature of the belts 96 and 68 and the resilient mounting of the pulleys 66, a stack of notes up to 6 millimeters in thickness (approximately 40 notes or more, depending on the condition of the notes) can be fed between the belts 96 and 118 and between the belts 68 and 70. Also, by virtue of the wide diameter (64 millimeters) of the pulleys 30, no distortion of such stack of notes occurs during the change of direction of movement of the stack as it passes partly around the peripheries of the pulleys 30. The pulleys 66 and 52 around which the belts 68 and 70 pass have a diameter (21 millimeters) much smaller than that of the pulleys 26 and 30.

If for any reason it is determined that the stack of notes 72 accumulated against the stationary belts 96 is to be rejected, for example as a result of the multiple note detect mechanism 234 having detected in the course of the stacking operation that two or more notes have been picked in a single pick operation, then the stack of notes 72 will be fed to the purge bin 112 in a manner which will now be described. Firstly, the motor 158 is temporarily activated as previously described so as to move the stripper arms 184 and the assembly of the belts 118 and arms 124, 132, 134 and 142 to the position shown in chain outline in FIG. 2 with the stack of notes 72 clamped between the belts 118 and 96. Next, the electronic control means 256 activates the motor 40 in such a sense as to cause the belts 118 and 96 to drive the stack of notes 72 to the nip D of the belts 96 and 110, from where the stack is fed by the belts 96 and 110 to the purge bin 112, the notes being deposited in the bin 112 through the opening 114. As the stack of notes approaches the bin 112, the sensor means 116 senses the leading edge of the stack. Shortly after the sensor means 116 senses the leading edge of the stack, the electronic control means 256 deactivates the motors 40 and 182 and temporarily activates the motor 158 in the reverse sense for the purpose of returning the stripper arms 184 and the assembly of the belts 118 and arms 124, 132, 134 and 142 to their original positions as shown in solid outline in FIG. 2. Again, it should be understood that by virtue of the stretchable nature of the belts 96 and 110 and the resilient mounting of the pulleys 94, a stack of notes up to 6 millimeters in thickness can be fed between the belts 96 and 110. Also, by virtue of the wide diameter of the pulleys 90, no distortion of such stack of notes occurs during the change of direction of movement of the stack as it passes partly around the peripheries of the pulleys 90. The pulleys 98 and 106 around which the belts 110 pass have a diameter (21 millimeters) much smaller than that of the pulleys 90.

The ATM hereinbefore described with reference to FIG. 4 is a rear loading ATM in which currency cassettes 246 are removed from, and replaced in, the dispenser unit 236 from the rear of the ATM, that is the side of the ATM opposite the user console 252. It should be understood that the novel features of the stacking and presenting mechanism 10 make it possible for the mechanism 10 to be readily adapted for use in a front loading in-lobby ATM in which currency cassettes 246 are removed from, and replaced in, the dispenser unit 236 from the front of the ATM.

Referring to FIG. 2, the side walls 12 and 14 are provided with studs 58' and 63' symmetrically positioned with respect to the studs 58 and 63 about a central vertical plane perpendicular to the side walls 12 and 14. Also, the side walls 12 and 14 are provided with mounting holes 258 symmetrically positioned with respect to the mounting holes accommodating the shaft 44, and mounting holes 260 symmetrically positioned with respect to the mounting holes accommodating the shaft 46.

Figure 6:
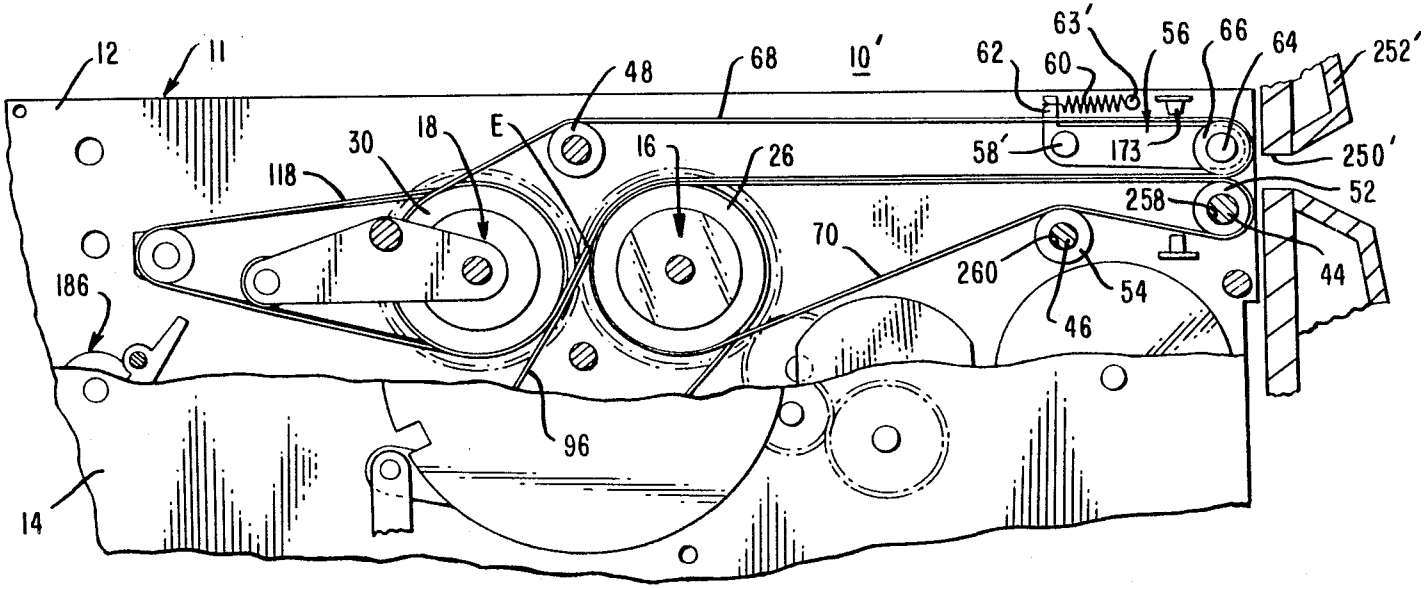
FIG. 6 is a part sectional, side elevational view of the mechanism of FIGS. 1 to 3 but showing the mechanism in a front loading configuration and additionally showing part of the user console, the section being taken along the same line as in FIG. 2.

Referring now to FIG. 6, a modified stacking and presenting mechanism 10' is included in a front loading in-lobby ATM having a user console 252' and a safe door (not shown) provided at the front of the ATM. In the mechanism 10', the shaft 44 and the associated pulleys 52 are mounted at the end of the framework 11 remote from the transport mechanism 186, the shaft 44 being accommodated in the mounting holes 258. The shaft 46 and the associated pulleys 54 are positioned between the pulleys 52 and the composite pulley 16, the shaft 46 being accommodated in the mounting holes 260. Also, the arms 56, the springs 60, the shaft 64 and the associated pulleys 66 are repositioned adjacent the end of the framework 11 remote from the transport mechanism 186, the arms 56 being rotatably mounted on the studs 58' respectively secured to the side walls 12 and 14. The ends of each spring 60 are attached to the respective stud 63' and the lug 62 of the respective arm 56, whereby the assembly of the arms 56, shaft 64 and pulleys 66 are urged to rotate in a clockwise direction with reference to FIG. 6. In addition, the belts 68 are repositioned so as to pass around the pulleys 30, 48, and 66, and partly around the peripheries of the pulleys 26, and the belts 70 are repositioned so as to pass around the pulleys 26 and 52, and over the pulleys 54. The only other difference between the stacking and presenting mechanism 10' and the stacking and presenting mechanism 10 shown in FIGS. 1 to 3 is that the optical sensing means 173 are repositioned adjacent the end of the framework 11 remote from the transport mechanism 186 so as to sense the approach of a stack of notes to the user console 252'. In a note present operation of the mechanism 10', a stack of notes is fed by the belts 118 and 96 to the nip E of the belts 68 and 70, whereafter the stack is fed by the belts 68 and 70 to the exit port 250' in the user console 252'.

Apart from the differences referred to hereinbefore, the modified mechanism 10' is exactly the same as the mechanism 10 described with reference to FIGS. 1 to 3. Thus, it is a very simple matter to change the stacking presenting mechanism from a mechanism adapted for use with a rear loading ATM to a mechanism adapted for use with a front loading ATM, or vice versa, since all that is required is a repositioning of the shafts 44 and 46 and associated pulleys 52 and 54, the assembly of the arms 56, springs 60, shaft 64 and pulleys 66, the belts 68 and 70, and the sensing means 173.

Other advantages of the stacking and presenting mechanism 10, or the modified mechanism 10', described above are that the mechanism is of simple construction and is compact in size. A further advantage of the mechanism 10 or 10' is that, when it is incorporated in a cash dispenser unit, the purge bin is always located at the same side of the unit as the currency cassettes.

While the form of the invention shown and described herein is admirably adapted to fulfill the objects primarily stated, it is to be understood that it is not intended to confine the invention to the form or embodiment disclosed herein, for it is susceptible of embodiment in various other forms within the scope of the appended claims.

I claim:

1. Sheet handling apparatus, comprising:

stacking means for accumulating sheets into a stack; and feeding means for feeding said stack to an exit location, said feeding means comprising a supporting framework; first and second pulley means having fixed axes and being mounted in a central portion of said supporting framework; third and fourth pulley means mounted in said supporting framework and disposed adjacent said exit location; first and second endless belt means, first ends of said first and second belt means respectively passing around said first and second pulley means, second ends of said first and second belt means respectively passing around said third and fourth pulley means, said first belt means being resiliently stretchable, part of said first belt means being in cooperative relationship with respect to part of said second belt means for the purpose of feeding said stack to said exit location, said first and second pulley means having substantially the same diameter and serving to drive said first and second belt means, said first belt means passing partly around the periphery of said second pulley means; third and fourth endless belt means for feeding a stack of sheets to said first and second endless belt means, said stacking means being mounted lower than said first and second endless belt means; fifth and sixth pulley means around which said third and fourth belt means respectively pass, said fifth pulley means being mounted coaxially with respect to said first pulley means, and said sixth pulley means being mounted coaxially with respect to said second pulley means; seventh pulley means around which said fourth endless belt means pass; and arms which carry said seventh pulley means and which are pivotable about the axis of said second and sixth pulley means between a first position in which said seventh pulley means are remote from said third belt means and a second position in which said fourth belt means are positioned in cooperative relationship with said third belt means for the purpose of feeding said stack to said first and second belt means, said arms being arranged to be in said first position during a stacking operation in which sheets are accumulated into said stack against a portion of said third belt means.

2. The sheet handling apparatus of claim 1 in which said third belt means are resiliently stretchable.

3. Sheet handling apparatus, comprising:

stacking means for accumulating sheets into a stack; and feeding means for feeding said stack to an exit location, said feeding means comprising a supporting framework; first and second pulley means having fixed axes and being mounted in a central portion of said supporting framework; third and fourth pulley means mounted in said supporting framework and disposed adjacent said exit location; and first and second endless belt means, first ends of said first and second belt means respectively passing around said first and second pulley means, second ends of said first and second belt means respectively passing around said third and fourth pulley means, said first belt means being resiliently stretchable, part of said first belt means being in cooperative relationship with respect to part of said second belt means for the purpose of feeding said stack to said exit location, said first and second pulley means having substantially the same diameter and serving to drive said first and second belt means, said first belt means passing partly around the periphery of said second pulley means; third and fourth endless belt means for feeding a stack of sheets to said first and second endless belt means, said stacking means being mounted lower than said first and second endless belt means; eighth pulley means adjacent said stacking means; a container for a rejected stack of sheets; ninth pulley means adjacent said container, said third endless belt means passing around said eighth and ninth pulley means;

fifth endless belt means; the part of said third belt means extending between said eighth and ninth pulley means cooperating with said fifth endless belt means for the purpose of feeding a rejected a stack of sheets to said container; and driving means for driving said third belt means in a first direction when a stack of sheets is to be fed to said exit location, and for driving, said third belt means in the opposite direction when a rejected stack of notes is to be fed to said container.

4. The sheet handling apparatus of claim 3, also including at least one further container for containing a supply of sheets; means for extracting sheets from said at least one further container; and means for feeding extracted sheets to said stacking means, said at least one further container being accessible for replenishment, and said rejected note container being accessible for emptying, from the same side of said framework.

5. The sheet handling apparatus of claim 3, in which said fifth endless belt means pass partly around the periphery of said eighth pulley means, said fifth belt means being resiliently stretchable.

6. The sheet handling apparatus of claim 3, in which the diameter of said eighth pulley means is substantially equal to that of said first and second pulley means.

7. Sheet handling apparatus, comprising:

stacking means for accumulating sheets into a stack; and feeding means for feeding said stack to an exit location, said feeding means comprising a supporting framework; first and second pulley means having fixed axes and being mounted in a central portion of said supporting framework; third and fourth pulley means mounted in said supporting framework and disposed adjacent said exit location; and first and second endless belt means, first ends of said first and second belt means respectively passing around said first and second pulley means, second ends of said first and second belt means respectively passing around said third and fourth pulley means, said first belt means being resiliently stretchable, part of said first belt means being in cooperative relationship with respect to part of said second belt means for the purpose of feeding said stack to said exit location, said first and second pulley means having substantially the same diameter and serving to drive said first and second belt means, said first belt means passing partly around the periphery of said second pulley means; said third and fourth pulley means being disposed adjacent one side of said framework, said apparatus also including mounting means on said framework, whereby said third and fourth pulley means may be repositioned adjacent the side of said framework opposite said one side, said first endless belt means may be repositioned so as to pass around said second pulley means and said third pulley means, and said second endless belt means may be repositioned so as to pass around said first pulley means and said fourth pulley means.

* * * * *

UNITED STATES PATENT AND TRADEMARK OFFICE

CERTIFICATE OF CORRECTION

PATENT NO. : 4,936,564

DATED : June 26, 1990

INVENTOR(S) : David A. Hain

It is certified that error appears in the above-identified patent and that said Letters Patent is hereby corrected as shown below:

Column 13, line 8, delete the comma, second occurrence.

Signed and Sealed this

Seventeenth Day of September, 1991

*Attest:*

HARRY F. MANBECK, JR.

*Attesting Officer*

*Commissioner of Patents and Trademarks*